2/1/77 XR 4,006,480

SR

United States Patent [19]

Charette et al.

[11] 4,006,480

[45] Feb. 1, 1977

[54] ANTENNA WINDOW ASSEMBLY FOR ABLATIVE HEAT SHIELDS

[75] Inventors: Raymond O. Charette, Fountain Valley; Hank A. Konczak, Costa Mesa, both of Calif.

[73] Assignee: The United States of America as represented by the Secretary of the Air Force, Washington, D.C.

[22] Filed: Feb. 3, 1976

[21] Appl. No.: 655,029

[52] U.S. Cl. ..... 343/705; 343/872

[51] Int. Cl.[2] ..... H01Q 1/42

[58] Field of Search ..... 343/705, 708, 872

[56] References Cited

UNITED STATES PATENTS 3,384,895 5/1968 Dorne et al. ..... 343/873

*Primary Examiner*—Eli Lieberman

*Attorney, Agent, or Firm*—Joseph E. Rusz; Henry S. Miller

[57] ABSTRACT

An antenna window for ablative type heat shield where the forward edge of the window is below the level of the heat shield and the trailing edge extends above the surface of the heat shield creating abrupt steps in the overall surface, precluding severe local material loss due to differences in ablation rates of the window and surrounding heat shield material.

1 Claim, 2 Drawing Figures

ANTENNA WINDOW ASSEMBLY FOR ABLATIVE HEAT SHIELDS

STATEMENT OF GOVERNMENT INTEREST

The invention described herein may be manufactured and used by or for the Government for governmental purposes without the payment of any royalty thereon.

BACKGROUND OF THE INVENTION

This invention relates generally to ablative type heat shielding and more particularly to a window for such shielding.

In space and other vehicles utilizing ablative heat shielding, it is frequently necessary to transmit and receive information and data via radio frequency instruments aboard the vehicle. These antennas must be provided with a window which will allow them to function while still maintaining the integrity of the heat shielding. Without such window, electromagnetic radiation to and from the antenna would be greatly impeded or blocked by the high density ablation heat shield.

Varying density in the heat shield by the incorporation of windows or other devices necessarily tends to vary the ablation rate of the shield and in particular in those areas where substitute materials are used. In regions of varying ablation rates, material loss along the interface is severe and hence steps must be taken to prevent failure of the heat shield.

One approach, to solve the problem of severe local material loss due to differences in ablation rates, has been the incorporation of a thicker end grain heat shield collar around the periphery of the window to allow extensive trailing edge ablation. This method has advantages with regard to the trailing edge but fails to correct deficiencies in the forward edge interface. Additionally, the collar is difficult to assemble in the heat shield and increases its cost.

SUMMARY OF THE INVENTION

The invention provides a simple and inexpensive means to preclude severe local material loss due to differences in ablation rates of antenna window material and the surrounding heat shield material.

The heat shield is constructed with an appropriately shaped aperture consistant with the requirement for the antenna or other device whose needs the window is intended to serve. The window is placed in the aperture and so machined to provide a tight fit. It extends through the heat shield and is secured to the heat shield support by an appropriate mechanical assembly. The window may be constructed of fused silica and assembled with the antenna located therein for ease of assembly with the heat shield and improved radio frequency reception.

The surface of the window subject to the ablating forces follows the radius of the heat shield in a direction transverse to the forces. In a direction along an axis parallel to the force of ablation, the forward edge of the window is depressed below the surface of the heat shield, forming an abrupt, rear facing step at the juncture. The rear or trailing edge of the window is raised to provide another abrupt step between the window and the heat shield.

It is therefore an object of the invention to provide a new and improved window for ablative heat shields.

It is another object of the invention to provide a new and improved window for ablative heat shields that prevents excessive heating at the leading and trailing heat shield-window interfaces.

It is a further object of the invention to provide a new and improved window for ablative heat shields that is more easily assembled than any hitherto known.

It is still another object of the invention to provide a new and improved window for ablative heat shields that is transparent to radio frequency electromagnetic energy.

It is still a further object of the invention to provide a new and improved window for ablative heat shields that prevents excessive material loss due to differing ablation rates.

It is another object of the invention to provide a new and improved window for ablative heat shields that is lower in cost than any known similar device.

These and other advantages, features and objects of the invention will become more apparent from the following description taken in connection with the illustrative embodiment in the accompanying drawing.

DESCRIPTION OF THE PREFERRED EMBODIMENT

Figure 1:
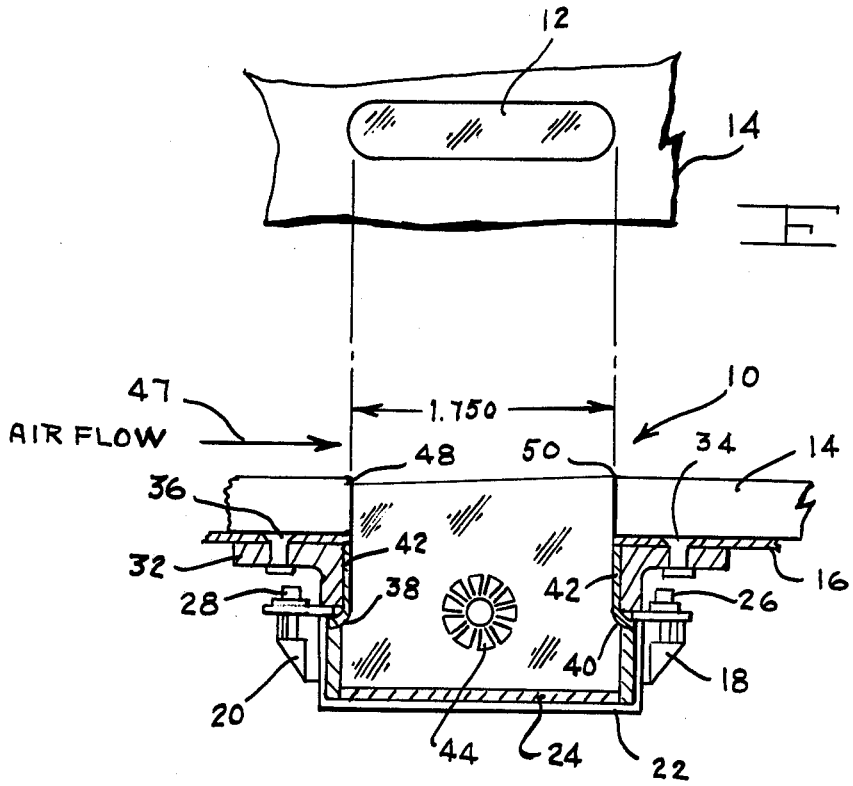
FIG. 1 is a side elevation view of the invention.
Figure 2:
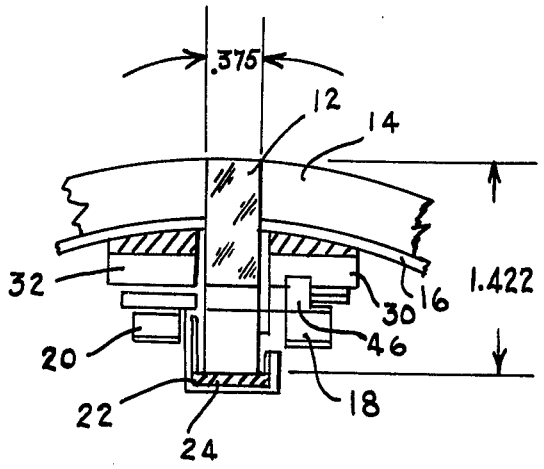
FIG. 2 is an end view of the invention partly in crossection.

Referring now to FIG. 1 and the window and its securing assembly are shown generally at 10. The window 12 fits into an aperture in the heat shield 14 supported by its backer 16. The window is held in position by a pair of retainers 18 and 20 mounted one on each side of the window and having a metal strap 22 connected therebetween. The strap 22 takes the general shape of the window 12 and through the appropriate cushioning, material 24 applies a force against the window as the threaded fasteners 26 and 28 take up on their respective retainers 18 and 20. The said fasteners transmit the force applied through the doublers 30, 32 which are held by rivits (34, 36) or otherwise securely attached to the heat shield backing plate 16.

The window 12 is provided with shoulders 38, 40 which abutt the appropriate doubler and hold the window secure as the threaded fastener applies pressure through the strap 22. Although the window is so constructed to provide a close fit with the heat shield, an appropriate silicon sealant 42 is placed around and between the periphery of the window and heat shield, doubler and retainer.

An antenna 44 may be fabricated within the window and supplied with a connector means 46.

Air flow across the heat shield is indicated by the arrow 47. The forward edge of the window 48 is depressed below the level of the heat shield 14 to provide an abrupt, rear facing step whereby air flowing across the heat shield will strike the window a slight distance from the actual interface. Similarly, the trailing edge 50 of the window 12 is raised above the level of the heat shield 14 providing an abrupt step causing the air to strike the heat shield a small distance from the window-heat shield interface. The diversion of the air or other gas will preclude severe local material loss due to differences in ablation rates of the two materials.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. An antenna window assembly for ablative heat shields having a support member and an aperture comprising: an ablative heat resistant window capable of passing radio frequency electromagnetic radiation, said window having a shape compatable with a heat shield aperture; a plurality bracket means adapted to be affixed to the heat shield support member; retainer means attached to the said bracket means adjacent said window; and a support means abutting the window at one end connected between at least two retainer means whereby the leading edge of said window does not extend into the air flow over the heat shield and the trailing edge of the window extends beyond the heat shield into the said air flow.

* * * * *